US009885494B2

(12) United States Patent
Badenhorst

(10) Patent No.: US 9,885,494 B2
(45) Date of Patent: Feb. 6, 2018

(54) SYSTEM AND METHOD FOR DELIVERING AIR

(75) Inventor: Sean Michael Johl Badenhorst, Dulwich Hill (AU)

(73) Assignee: Fusion HVAC Pty Limited, West End, Queensland (AU)

( * ) Notice: Subject to any disclaimer, the term of this patent is extended or adjusted under 35 U.S.C. 154(b) by 1226 days.

(21) Appl. No.: 13/514,974

(22) PCT Filed: Dec. 8, 2010

(86) PCT No.: PCT/AU2010/001660

§ 371 (c)(1),
(2), (4) Date: Oct. 8, 2012

(87) PCT Pub. No.: WO2011/069201

PCT Pub. Date: Jun. 16, 2011

(65) Prior Publication Data

US 2013/0023198 A1 Jan. 24, 2013

(30) Foreign Application Priority Data

Dec. 8, 2009 (AU) ..... 2009905988

(51) Int. Cl.
*B01D 46/00* (2006.01)
*F24F 13/06* (2006.01)
*F24F 13/26* (2006.01)

(52) U.S. Cl.
CPC ..... *F24F 13/06* (2013.01); *F24F 13/26* (2013.01); *Y10T 137/87627* (2015.04)

(58) Field of Classification Search
CPC ..... B01D 46/00
USPC ..... 454/269
See application file for complete search history.

(56) References Cited

U.S. PATENT DOCUMENTS 3,721,067 A * 3/1973 Agnew ..... 95/273
3,927,827 A 12/1975 Strindehag
4,026,321 A * 5/1977 Kahoe et al. ..... 137/487
4,189,939 A * 2/1980 West et al. ..... 73/116.03
4,738,188 A * 4/1988 Nishida ..... 454/229
4,852,639 A * 8/1989 Horiguchi et al. ..... 165/42
5,094,152 A * 3/1992 Muller ..... F24F 13/06 454/296
5,370,578 A * 12/1994 Yi ..... F24F 13/26 251/212
5,685,162 A * 11/1997 Iritani et al. ..... 62/156
(Continued)

FOREIGN PATENT DOCUMENTS

FR 2451550 11/1980

OTHER PUBLICATIONS

Patent Examination Report #1 for Australian Patent Application No. 2010330689, dated Nov. 14, 2014.
(Continued)

*Primary Examiner* — Steven B McAllister
*Assistant Examiner* — Samantha Miller
(74) *Attorney, Agent, or Firm* — Knobbe, Martens, Olson & Bear, LLP

(57) ABSTRACT

A method for delivering air comprising the steps of:
discharging a first air stream, wherein the mass flow rate of first air stream can be varied; and
discharging a second air stream, wherein the second air stream is arranged to induce the first air stream to deliver a combined air stream with a mass flow rate that can be varied.

15 Claims, 7 Drawing Sheets

(56) References Cited

U.S. PATENT DOCUMENTS

| | | | | |
|---|---|---|---|---|
| 5,738,779 | A * | 4/1998 | Dach et al. | 208/143 |
| 6,132,310 | A * | 10/2000 | Baribeault et al. | 454/261 |
| 6,251,007 | B1 * | 6/2001 | Smith | 454/292 |
| 6,332,111 | B1 * | 12/2001 | Fincke | 702/50 |
| 6,430,951 | B1 * | 8/2002 | Iritani et al. | 62/229 |
| 6,904,968 | B2 * | 6/2005 | Beitelmal | G06F 1/206 165/247 |
| 7,862,410 | B2 * | 1/2011 | McMahan et al. | 454/184 |
| 8,974,272 | B2 * | 3/2015 | Mornan et al. | 454/39 |
| 9,091,217 | B2 * | 7/2015 | Hodinot et al. | |
| 2006/0023424 | A1 * | 2/2006 | Nakamura et al. | 361/699 |
| 2007/0066212 | A1 * | 3/2007 | Klingler | B60H 1/3457 454/155 |
| 2007/0184772 | A1 * | 8/2007 | McConnell | B60H 1/249 454/139 |
| 2008/0202333 | A1 * | 8/2008 | Matsuura et al. | 95/55 |
| 2008/0239668 | A1 * | 10/2008 | Hendrix et al. | 361/695 |
| 2008/0254732 | A1 * | 10/2008 | Voigt | B60H 1/0065 454/143 |
| 2010/0011869 | A1 * | 1/2010 | Klosinski et al. | 73/700 |
| 2010/0136895 | A1 * | 6/2010 | Sgro | 454/184 |
| 2011/0072911 | A1 * | 3/2011 | Osburn et al. | 73/861.42 |
| 2013/0143480 | A1 * | 6/2013 | Trevelyan | 454/284 |

OTHER PUBLICATIONS

Written Opinion for International Application No. PCT/AU2010/001660 from the International Searching Authority, dated Feb. 10, 2011.

International Preliminary Report on Patentability for International Application No. PCT/AU2010/001660, dated Jun. 12, 2012 by the International Bureau of WIPO.

International Search Report, dated Feb. 10, 2011, issued in International Application No. PCT/AU2010/001660.

First Examination Report, dated Mar. 22, 2013, issued in New Zealand Patent Application No. 601090, which is the New Zealand equivalent of the above-referenced U.S. Patent Application.

* cited by examiner

SYSTEM AND METHOD FOR DELIVERING AIR

TECHNICAL FIELD

The present invention relates to a system and method for delivering air. Embodiments of the invention find particular, but not exclusive, use in generating an air stream in long throw sidewall air diffusion applications.

BACKGROUND

Many buildings have air conditioning or ventilation systems which distribute air throughout the building through ducts and vents. These systems can be costly and relatively cumbersome to install. In addition, the air from a cooling or heating source may not be properly distributed throughout the building to provide adequate conditioning of the air inside the building.

Traditionally, heating, ventilation and air conditioning (HVAC) systems are constructed to provide a certain maximum cooling or heating capacity based on the specification of the building. On days where the maximum capacity is not needed, operators may not be able to readily adjust the settings of the HVAC system in order to save on energy usage. In other situations, the air discharged from the ventilation system cannot be directed or controlled and, as such, may cause stratification or draughts within an environment as the movement and behaviour of warm or cold air can vary when discharged from a ventilation system, especially as heat loads change. This results in less efficient operation of the ventilation system within the building.

SUMMARY OF THE INVENTION

In accordance with a first aspect of the present invention, there is provided a method for delivering air comprising the steps of:

discharging a first air stream, wherein the mass flow rate of the first air stream can be varied; and discharging a second air stream, wherein the second air stream is arranged to induce the first air stream to deliver a combined air stream with a mass flow rate that can be varied.

In an embodiment of the first aspect, the first air stream is discharged in close proximity to the second air stream.

In an embodiment of the first aspect, the second air stream is a jet discharged at a higher velocity relative to the discharge of the first air stream.

In an embodiment of the first aspect, the second air stream is a jet discharged at a higher momentum relative to the discharge of the first air stream.

In an embodiment of the first aspect, the direction of the second air stream is controllable.

In an embodiment of the first aspect, the second air stream is arranged to control the direction of the combined air stream.

In an embodiment of the first aspect, the second air stream is arranged to control the throw of the combined air stream.

In an embodiment of the first aspect, the throw and discharge direction of the combined air stream is substantially determined by the throw and discharge direction of the second air stream.

In an embodiment of the first aspect, the second air stream is discharged at a substantially constant mass flow rate.

In an embodiment of the first aspect, the second air stream is discharged at a substantially constant throw.

In an embodiment of the first aspect, the combined air stream is discharged at a substantially constant throw.

In an embodiment of the first aspect, the throw of the second air stream, if discharged in the absence of the first air stream, is higher than the throw of the first air stream, if discharged in the absence of the second air stream.

In an embodiment of the first aspect, the throw of one air stream in the absence of the other air stream is largely calculated by the steps of:

applying a square root function to the product of the mass flow rate and the discharge velocity of the air stream to define a value; and dividing the value by the induction ratio of the air stream.

In an embodiment of the first aspect, the second air stream is discharged by at least one outlet, grille, nozzle or jet.

In an embodiment of the first aspect, the first air stream is discharged by at least one perforated plate.

In an embodiment of the first aspect, the first air stream is discharged by at least one swirl diffuser.

In an embodiment of the first aspect, the combined air stream is discharged substantially horizontally.

In an embodiment of the first aspect, the discharge of the first air stream is controlled by at least one damper.

In an embodiment of the first aspect, the first air stream is supplied by at least one variable speed drive fan.

In an embodiment of the first aspect, the supply air pressure of the supply air plenum from which the first air stream is discharged is substantially equal to the supply air pressure of the supply air plenum or duct from which the second air stream is discharged.

In an embodiment of the first aspect, the supply air pressure in the supply air plenum from which either air stream is discharged is largely constant.

In accordance with a second aspect of the present invention, there is provided a system for delivering air comprising:

a first discharging arrangement arranged to discharge a first air stream, wherein the mass flow rate of the first air stream can be varied; and a second discharging arrangement arranged to discharge a second air stream, wherein the second air stream is arranged to induce the first air stream to deliver a combined air stream with a mass flow rate that can be varied.

In an embodiment of the second aspect, the first air stream is a jet discharged in close proximity to the second air stream.

In an embodiment of the second aspect, the second air stream is discharged at a higher velocity relative to the discharge of the first air stream.

In an embodiment of the second aspect, the second air stream is a jet discharged at higher momentum relative to the discharge of the first air stream.

In an embodiment of the second aspect, the direction of the second air stream is controllable.

In an embodiment of the second aspect, the second air stream is arranged to control the direction of the combined air stream.

In an embodiment of the second aspect, the second air stream is arranged to control the throw of the combined air stream.

In an embodiment of the second aspect, the throw and discharge direction of the combined air streams is substantially determined by the throw and discharge direction of the second air stream.

In an embodiment of the second aspect, the second air stream is discharged at a substantially constant mass flow rate.

In an embodiment of the second aspect, the second air stream is discharged at a substantially constant throw.

In an embodiment of the second aspect, the combined air stream is discharged at a substantially constant throw.

In an embodiment of the second aspect, the throw of the second air stream, if discharged in the absence of the first air stream, is higher than the throw of the first air stream, if discharged in the absence of the second air stream.

In an embodiment of the second aspect, the throw of one air stream in the absence of the other air stream is calculated by the steps of:

applying a square root function to the product of the mass flow rate and the discharge velocity of the air stream to define a value; and dividing the value by the induction ratio of the air stream.

In an embodiment of the second aspect, the second discharging arrangement is at least one outlet, grille, nozzle or jet.

In an embodiment of the second aspect, the first discharge arrangement is at least one perforated plate.

In an embodiment of the second aspect, the first discharge arrangement is at least one swirl diffuser.

In an embodiment of the second aspect, the combined air stream is discharged substantially horizontally.

In an embodiment of the second aspect, the discharge of the first air stream is controlled by at least one damper.

In an embodiment of the second aspect, the first air stream is supplied by at least one variable speed drive fan.

In an embodiment of the second aspect, the supply air pressure of the supply air plenum from which the first air stream is discharged is largely equal to the supply air pressure of the supply air plenum from which the second air stream is discharged.

In an embodiment of the second aspect, the supply air pressure in the supply air plenum from which either air stream is discharged is largely constant.

In accordance with a third aspect of the present invention, there is provided an air delivery mechanism comprising:

an outlet arranged to discharge a first air stream, wherein the mass flow rate of the first air stream is variable; and a nozzle arranged to discharge a second air stream, wherein the second air stream is arranged to induce the first air stream to define a combined air stream with a mass flow rate that is variable.

In an embodiment of the third aspect, the outlet is in close proximity to the nozzle.

In an embodiment, the outlet may be one of a perforated plate and a swirl diffuser.

In an embodiment of the third aspect, the second air stream is discharged at a higher velocity relative to the discharge of the first air stream.

In an embodiment of the third aspect, the second air stream is a jet discharged at higher momentum relative to the discharge of the first air stream.

In an embodiment of the third aspect, the direction of the second air stream is controllable.

In an embodiment of the third aspect, the second air stream is arranged to control the direction of the combined air stream.

In an embodiment of the third aspect, the second air stream is arranged to control the throw of the combined air stream.

In an embodiment of the third aspect, the throw and discharge direction of the combined air streams is substantially determined by the throw and discharge direction of the second air stream.

In an embodiment of the third aspect, the second air stream is discharged at a substantially constant mass flow rate.

In an embodiment of the third aspect, the second air stream is discharged at a substantially constant throw.

In an embodiment of the third aspect, the combined air stream is discharged at a substantially constant throw.

In an embodiment of the third aspect, the throw of the second air stream, if discharged in the absence of the first air stream, is higher than the throw of the first air stream, if discharged in the absence of the second air stream.

In an embodiment of the third aspect, the throw of one air stream in the absence of the other air stream is calculated by the steps of:

applying a square root function to the product of the mass flow rate and the discharge velocity of the air stream to define a value; and dividing the value by the induction ratio of the air stream.

In an embodiment of the third aspect, the combined air stream is discharged substantially horizontally.

In an embodiment of the third aspect, the discharge of the first air stream is controlled by at least one damper.

In an embodiment of the third aspect, the first air stream is supplied by at least one variable speed drive fan.

In an embodiment of the third aspect, the supply air pressure of the supply air plenum from which the first air stream is discharged is substantially equal to the supply air pressure of the supply air plenum from which the second air stream is discharged.

In an embodiment of the third aspect, the supply air pressure in the supply air plenum from which either air stream is discharged is largely constant.

In accordance with a fourth aspect of the present invention, there is provided a unit for the discharge of air comprising:

a housing, the housing incorporating a mechanism to deliver air in accordance with the third aspect of the invention; and an air supply module arranged to supply a flow of air, wherein the housing is arranged to be connected to an air supply, module arranged to supply a flow of conditioned air.

In an embodiment of the fourth aspect, the housing is directly connected to at least one air supply opening in the air supply module.

In an embodiment of the fourth aspect, the housing is connected to the air supply module via at least one air tight gasket.

In an embodiment of the fourth aspect, the unit may be inserted to penetrate through a wall, ceiling or roof penetration from the outside of a space to which it is to deliver air.

In an embodiment of the fourth aspect, the housing is supported by a wall, ceiling or roof penetration.

In an embodiment of the fourth aspect, the housing forms a seal with a wall, ceiling or roof penetration.

In an embodiment of the fourth aspect, the housing has a shoulder arranged to engage and seal the housing to a wall, ceiling or roof.

In an embodiment of the fourth aspect, the housing includes a duct for the passage of return air to the air supply module.

In an embodiment of the fourth aspect, the housing is directly connected to at least one return air opening in the air supply module.

In an embodiment of the fourth aspect, the housing is further connected to the air supply module via at least one air tight gasket.

In accordance with a fifth aspect of the present invention, there is provided a method of installation of a unit in accordance with the fourth aspect of the invention comprising the steps of:

lowering the unit into an aperture in a roof of a building such that the unit is brought into communication with the air inside the building; and installing the air supply module to be in communication with the unit.

In an embodiment of the fifth aspect, the unit includes a peripheral flange surrounding at least one upper opening of the unit, the flange being in communication with at least one structural member of the roof penetration such that the member bears the weight of the unit once the unit has been lowered into the roof aperture.

In an embodiment of the fifth aspect, the peripheral flange of the unit engages a seal when the unit has been lowered into place in the roof aperture.

In an embodiment of the fifth aspect, the seal comprises a deformable gasket.

In an embodiment of the fifth aspect, the unit includes a supply air seal about the supply air opening that is engaged when the air supply module is lowered into the unit.

In an embodiment of the fifth aspect, the supply air seal comprises a deformable gasket.

In an embodiment of the fifth aspect, the unit includes a return air seal about the return air opening that is engaged when the air supply module is lowered into the unit.

In an embodiment of the fifth aspect, the return air seal comprises a deformable gasket.

In accordance with a sixth aspect of the present invention, there is provided an air delivery system comprising:

an outlet arranged to discharge a first air stream, wherein the mass flow rate of the first air stream can be varied; and a nozzle arranged to discharge a second air stream, wherein the second air stream is arranged to induce the first air stream to define a combined air stream with a mass flow rate that can be varied.

In an embodiment of the sixth aspect, the outlet and the nozzle are arranged in close proximity to one another.

In an embodiment of the sixth aspect, the outlet are of a perforated plate and swirl diffuser.

In an embodiment of the sixth aspect, the second air stream is discharged at a higher velocity relative to the discharge of the first air stream.

In an embodiment of the sixth aspect, the second air stream is discharged at a higher momentum relative to the discharge of the first air stream.

In an embodiment of the sixth aspect, the direction of the second air stream is controllable.

In an embodiment of the sixth aspect, the second air stream is arranged to control the direction of the combined air stream.

In an embodiment of the sixth aspect, the second air stream is arranged to control the throw of the combined air stream.

In an embodiment of the sixth aspect, both the throw and discharge direction of the combined air stream are substantially determined by the throw and discharge direction of the second air stream.

In an embodiment of the sixth aspect, the second air stream is discharged at a substantially constant mass flow rate.

In an embodiment of the sixth aspect, the second air stream is discharged at a substantially constant throw.

In an embodiment of the sixth aspect, the throw of the second air stream, if discharged in the absence of the first air stream, is higher than the throw of the first air stream, if discharged in the absence of the second air stream.

In an embodiment of the sixth aspect, the throw of one air stream in the absence of the other air stream is largely calculated by the steps of:

applying a square root function to the product of the mass flow rate and the discharge velocity of the air stream to define a value; and dividing the value by the induction ratio of the air stream.

In an embodiment of the sixth aspect, the combined air stream is discharged substantially horizontally.

In an embodiment of the sixth aspect, the first air stream is supplied by at least one variable speed drive fan.

In an embodiment of the sixth aspect, the nozzle is controlled by an actuator arranged to adjust the discharge angle of the nozzle.

In an embodiment of the sixth aspect, the actuator is electrically powered.

In an embodiment of the sixth aspect, the actuator is thermally powered.

In an embodiment of the sixth aspect, the perforated plate or swirl diffuser has an adjustable damper arranged to vary the mass flow rate of the first air stream.

In an embodiment of the sixth aspect, the damper is electrically powered.

In an embodiment of the sixth aspect, the damper is thermally powered.

In an embodiment of the sixth aspect, the horizontal distance of supply air throw is adjustable.

In an embodiment of the sixth aspect, the housing may house a supply air duct, and houses a supply air plenum, the nozzle, and the perforated plate or the swirl diffuser.

In an embodiment of the sixth aspect, the housing may be inserted through a wall, ceiling or roof penetration from the outside of a space to which it is to deliver air.

In an embodiment of the sixth aspect, the housing is directly connected to the supply air openings of an air conditioner, fan, air handler or heat pump.

In an embodiment of the sixth aspect, the system further comprises a housing arranged to house a return air system.

In an embodiment of the sixth aspect, the return air system includes a return air duct or plenum drawing return air from the space to which the housing supplies air.

In an embodiment of the sixth aspect, the housing system is directly connected to the return air openings of the air conditioner, fan, air hander or heat pump.

In an embodiment of the sixth aspect, the housing is connected to the heat pump, fan, air conditioner, or air handler via an air tight gasket.

In an embodiment of the sixth aspect, the housing forms a seal with a wall, ceiling or roof penetration.

In an embodiment of the sixth aspect, the housing is supported by a wall, ceiling or roof penetration.

In an embodiment of the sixth aspect, the housing may be inserted to penetrate through a wall, ceiling or roof penetration from the outside of a space to which it is to deliver air.

In an embodiment of the sixth aspect, the housing has a shoulder arranged to engage and seal the housing to a wall, ceiling or roof penetration.

In an embodiment of the sixth aspect, the airflow rate supplied by the fan is adjusted to maintain a substantially constant air pressure in the housing.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1A:
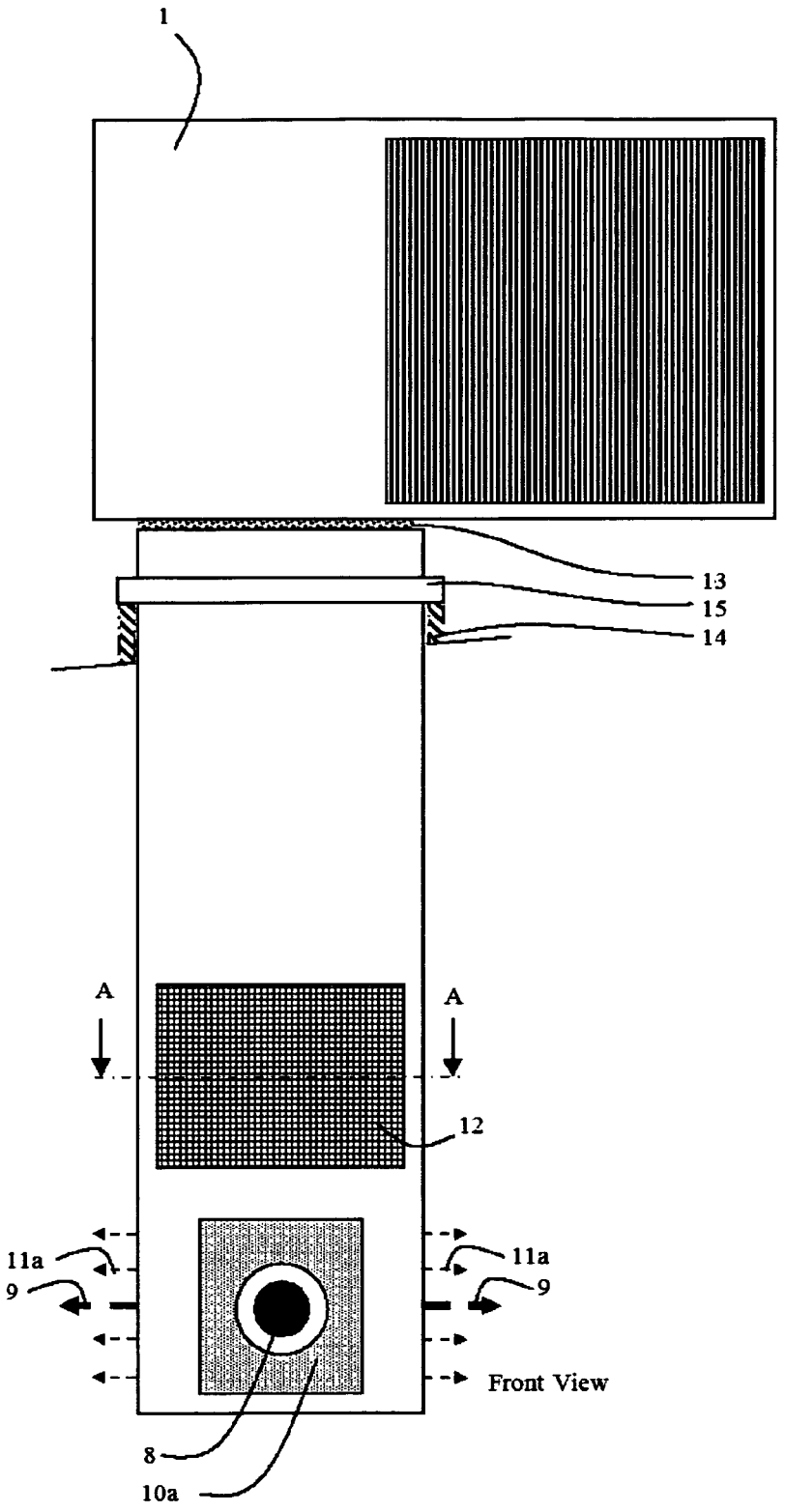
FIG. 1A is a front view of a system for delivering air in accordance with an embodiment of the present invention.
Figure 1B:
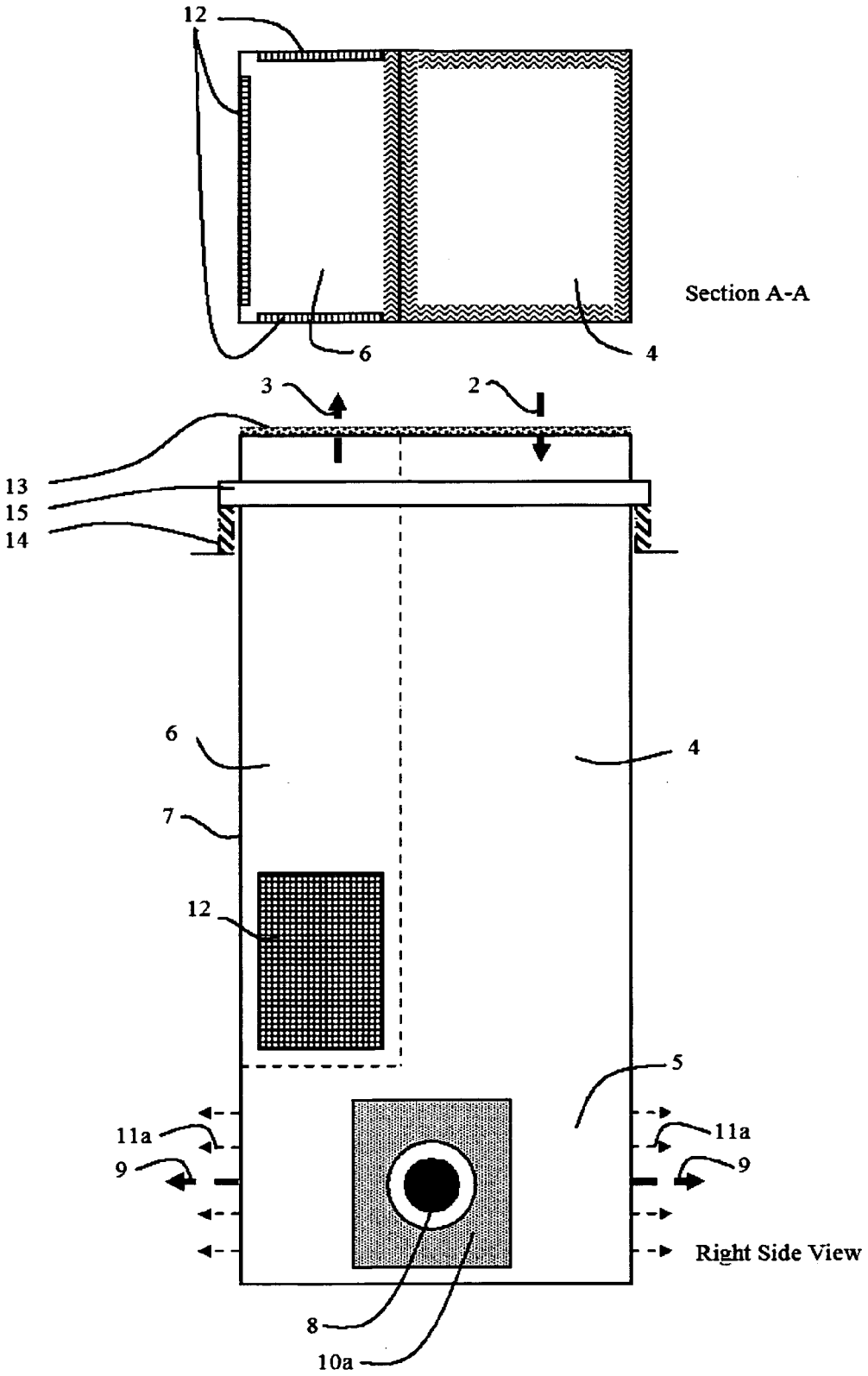
FIG. 1B is a side view of a system illustrated in FIG. 1A.

Referring to FIGS. 1A and 1B, there is shown an embodiment of a system for delivering air comprising the steps of: discharging a first air stream, wherein the mass flow rate of the first air stream can be varied; and discharging a second air stream, wherein the second air stream is arranged to induce the first air stream to deliver a combined air stream with a mass flow rate that can be varied.

In this embodiment, the system is connected to a heat pump (1) (not shown in FIG. 1B) having a variable speed drive supply air fan system arranged to allow an operator or controller to adjust the mass flow rate of the supply air (2) travelling from heat pump (1). Supply air (2), therefore, may have a variable mass flow rate, which is delivered to supply duct (4) and supply plenum (5). Associated return air (3) is drawn from operating environment (16) into return duct (6) for circulation or removal.

In this embodiment, the various components of supply duct (4), supply plenum (5) and return duct (6) are all contained in a common housing (7), which may be installed from the roof or ceiling of a structure. The housing (7) may be connected to a heat pump (1) located on the rooftop of the structure. Heat pump (1), having a variable speed drive fan, supplies air through an opening in the underside of heat pump (1) into supply duct (4), which directs the supplied air into supply plenum (5), with the operator or controller adjusting the variable speed drive fan system in heat pump (1) to increase or decrease the volume flow rate of supply air (2) to maintain a largely constant supply air pressure in supply plenum (5). Supply air (2) is discharged from supply plenum (5) into the operating environment (16) by nozzles (8), which produce high velocity jet-like air streams (9) with largely constant airflow rate and throw, and by perforated plates (10*a*), which produce low velocity air streams (11*a*).

One or more motorised dampers (not shown) may vary the supply air stream from supply plenum (5) to perforated plates (10*a*), thereby varying the airflow rate of the low velocity air streams (11*a*). Because of its close proximity to the adjacent high velocity air stream (9) discharged by nozzle (8), each low velocity air stream (11*a*) is induced by the adjacent high velocity air stream (9) to form a combined air stream that may be of varying volume flow rate, that has a largely constant horizontal throw, and that has a discharge direction that is determined largely by the discharge direction of the high velocity air stream (9).

It will be apparent to the person skilled in the art that perforated plate (10*a*) may be replaced by other air outlet systems that produce low velocity discharge in comparison to that of the adjacent high velocity air stream (9). For example, perforated plate (10*a*) may be replaced by a grille with an upstream damper.

In this embodiment, return air is drawn from the space through grilles (12). As shown in this embodiment, supply duct (4) and return duct (6) in the common housing (7) are arranged to be installed to the underside of heat pump (1) via airtight gasket (13) and to form a watertight seal through roof penetration upstands (14) via support shoulder (15).

Figure 2A:
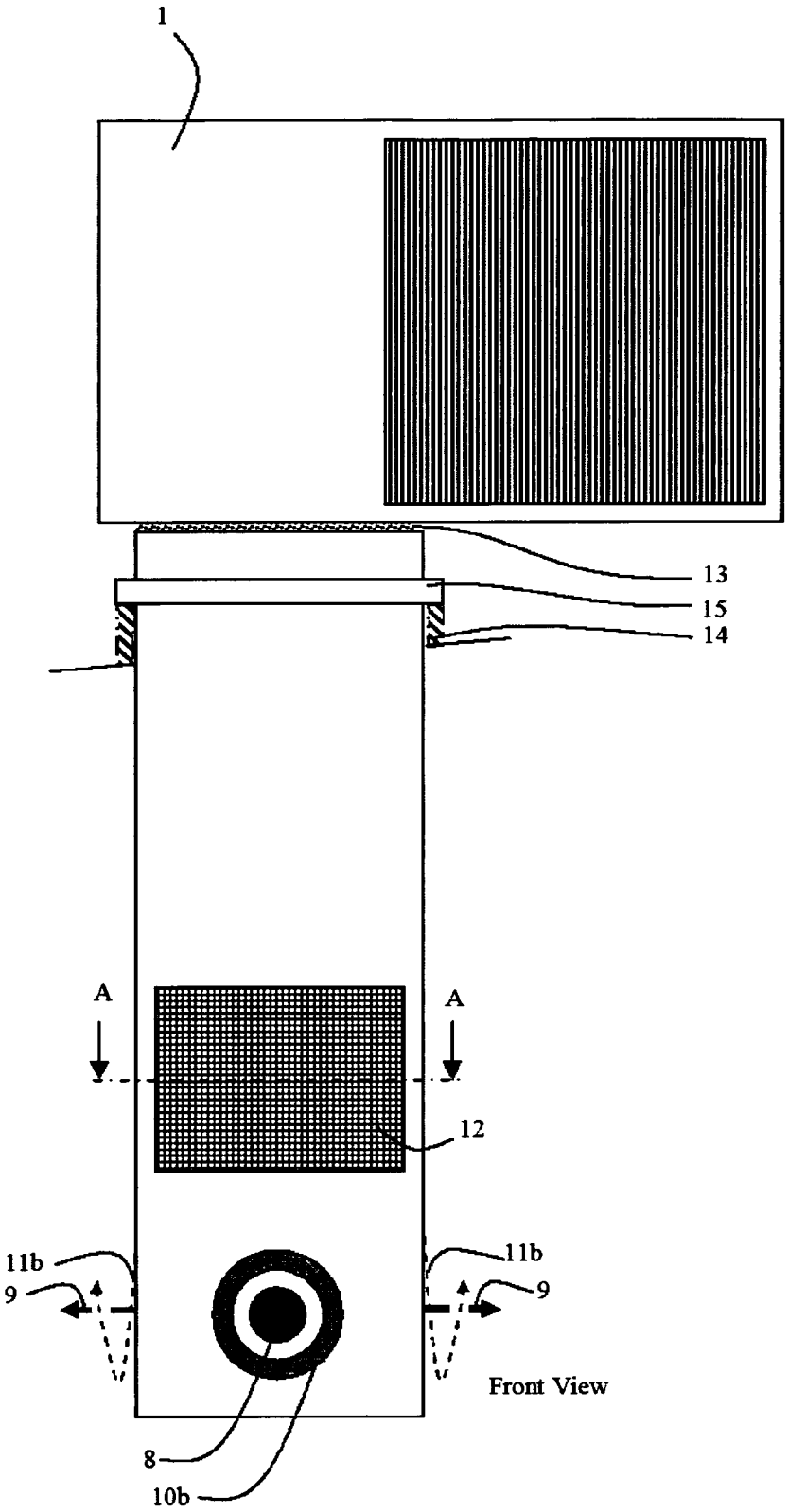
FIG. 2A is a front view of a system for delivering air in accordance with an embodiment of the present invention.
Figure 2B:
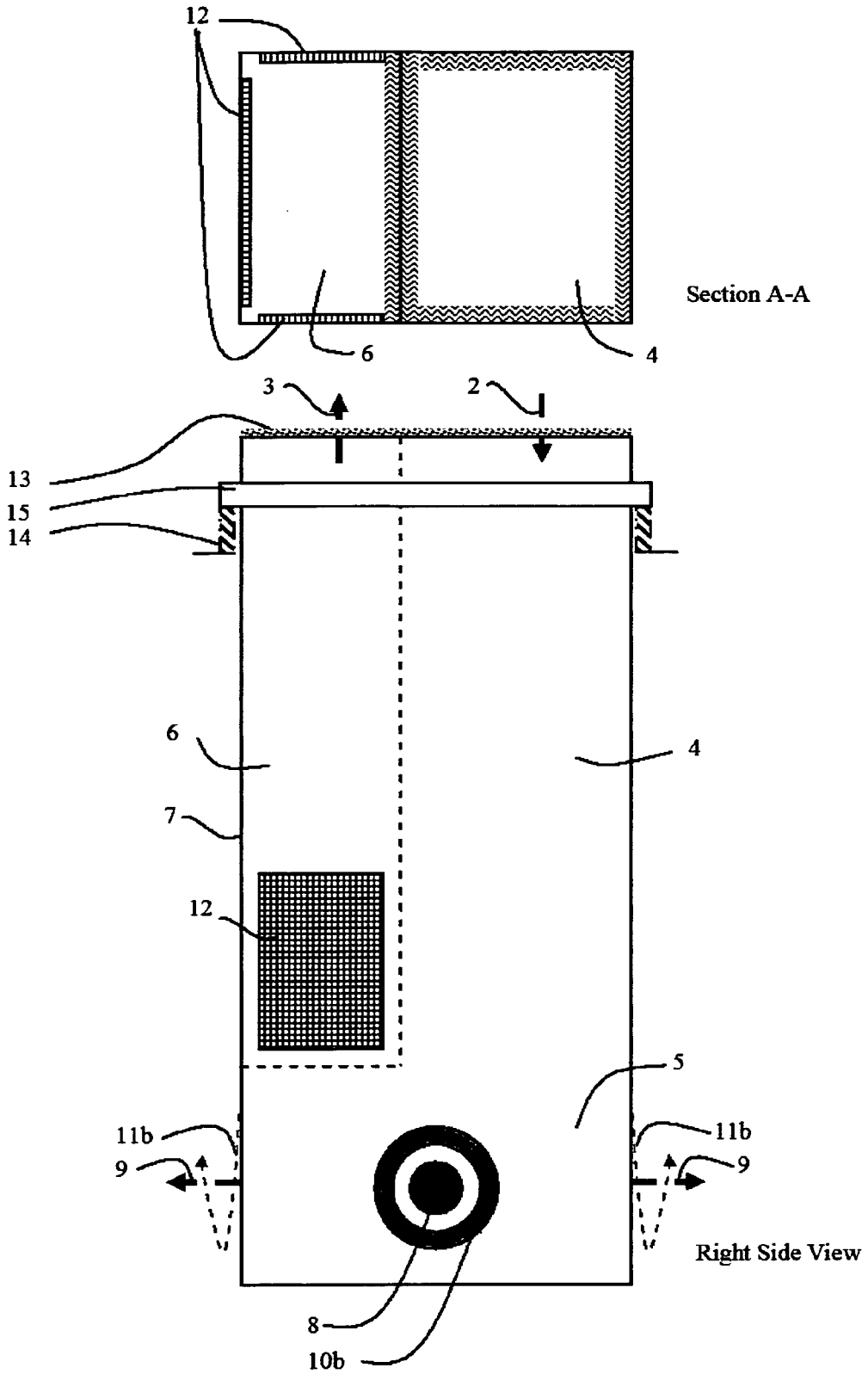
FIG. 2B is a side view of a system illustrated in FIG. 2A.

With reference to FIGS. 2A and 2B, there is shown another embodiment of the present invention. In this embodiment, the supply air (2) having a variable mass flow rate is delivered to supply duct (4) and supply plenum (5) from heat pump (1) (not shown in FIG. 2B). Housing (7) houses supply duct (4), supply plenum (5) and return duct (6), which is arranged to return air from the operating environment (16) within the building to heat pump (1) or to vent it to the exterior of the building (not shown).

In this embodiment, the airflow rate of supply air (2) supplied by heatpump (1) is adjusted to maintain a largely constant supply air pressure in supply plenum (5). Air from supply plenum (5) is discharged largely horizontally from nozzles (8), each of which produces a high velocity jet-like air stream (9) with largely constant airflow rate and throw. The supply air is also discharged via motorised dampers (not shown) through swirl diffusers (10*b*) to produce low velocity swirling air streams (11*b*) of varying mass flow rate that in each case is induced by the adjacent high velocity air streams (9) to form a combined air stream that has varying volume flow rate, that has a largely constant horizontal throw, and that has a discharge direction that is determined largely by the discharge direction of the high velocity air stream (9).

In these embodiments, the high velocity air stream (also known as a jet) (9) discharged by the nozzle (8) is capable of dominating over the low velocity air stream (11*a* or 11*b*) discharged from the perforated plate or swirl diffuser, respectively, which is discharged in close proximity to the jet (9).

In these situations, each air stream, when discharged in the absence of the other, has a throw that can be described by:

1. the square root function of (discharged mass flow rate multiplied by discharge velocity);
2. divided by the induction ratio, where the induction ratio is the sum of primary air flow rate and the secondary air flow rate induced into the primary air stream from the environment, all divided by the primary air flow rate.

In situations where the throw of one air stream is substantially greater than that of the other air stream, and where the two air streams are in sufficiently close proximity to one another to combine into a single air stream, then the air stream with the greater throw, as defined above, will dominate the other air stream in terms of throw and discharge direction. This is illustrated by the formula:

$$\frac{\sqrt{(\dot{M}_1 \times v_1)}}{I_1} >> \frac{\sqrt{(\dot{M}_2 \times v_2)}}{I_2}$$

where:

$\dot{M}_1$=Mass flow rate of discharged supply air stream 1

$v_1$=Discharge velocity of discharged supply air stream 1

$I_1$=Induction ratio over the entire throw of discharged supply air stream 1

$\dot{M}_2$=Mass flow rate of discharged supply air stream 2

$v_2$=Discharge velocity of discharged supply air stream 2

$I_2$=Induction ratio over the entire throw of discharged supply air stream 2

In accordance with the above formula, which compares the throw between two air streams, and in order for jet (9) (air stream "1" in the formula) to dominate, the mass flow rate of the supply air stream (11*a* or 11*b*) (air stream "2" in the formula) discharged in close proximity to the jet (air stream "1") may be greater than that of the jet (air stream "1") on condition that the discharge velocity of air stream "2" is lower than that of the jet (air stream "1") and/or the induction ratio of air stream "2" is greater than that of the jet (air stream "1"), such that the equation is satisfied. Therefore, in some embodiments, swirl discharge of air stream "2" is beneficial in comparison to discharge through a perforated plate, as swirl discharge produces a very much higher induction ratio than a perforated plate of large open area, thereby allowing a far smaller face area of discharge (i.e. a more compact design) and a larger discharged mass flow rate to be achieved (i.e. a better turn-down ratio from the maximum airflow rate of the combined air streams, when the airflow rate of air stream "2" in the formula is at its maximum, down to the minimum airflow rate of the combined air streams, when the airflow rate of air stream "2" in the formula is zero). In some examples concerning the jet and swirl discharge combination, the swirl discharge typically accounts for up to 60% of the total discharged airflow rate, thereby allowing the variable speed drive fan in the heat pump (1) to vary airflow rate from 40% under low load conditions (discharge through the jet alone) up to 100% (jet discharge plus swirl discharge) for high load conditions, whilst maintaining a largely constant pressure in the supply air plenum (5) to achieve a largely constant horizontal throw and stable discharge direction of the combined air streams, with both of these largely determined by the jet, which has the dominant airflow pattern.

Pointing the nozzle (8) into a specific direction may also direct the combined air stream largely in that same direction, as the jet (9) discharged by the nozzle (8) has the dominant airflow pattern. This is advantageous as air may be directed to a specific height of the building interior to achieve a desired effect. For example, during summer periods when the interior of the building requires cooling, the nozzle (8) may be angled upwards to compensate for the characteristics of cold supplied air being denser than room air and hence falling down over the trajectory of throw into the occupancy space. The situation is reversed in winter periods when warm supply air is more buoyant than cold room air, whereby discharging the warm supply air diagonally downwards assists in improving heating effectiveness of the space. In some embodiments, the nozzle (8) may be angled by an actuator controlled electronically. In other embodiments, the actuator may be thermally controlled which in some examples, includes a fluid operated piston whereby the fluid expands when heated or contracts when cooled to provide the actuation.

Figure 3:
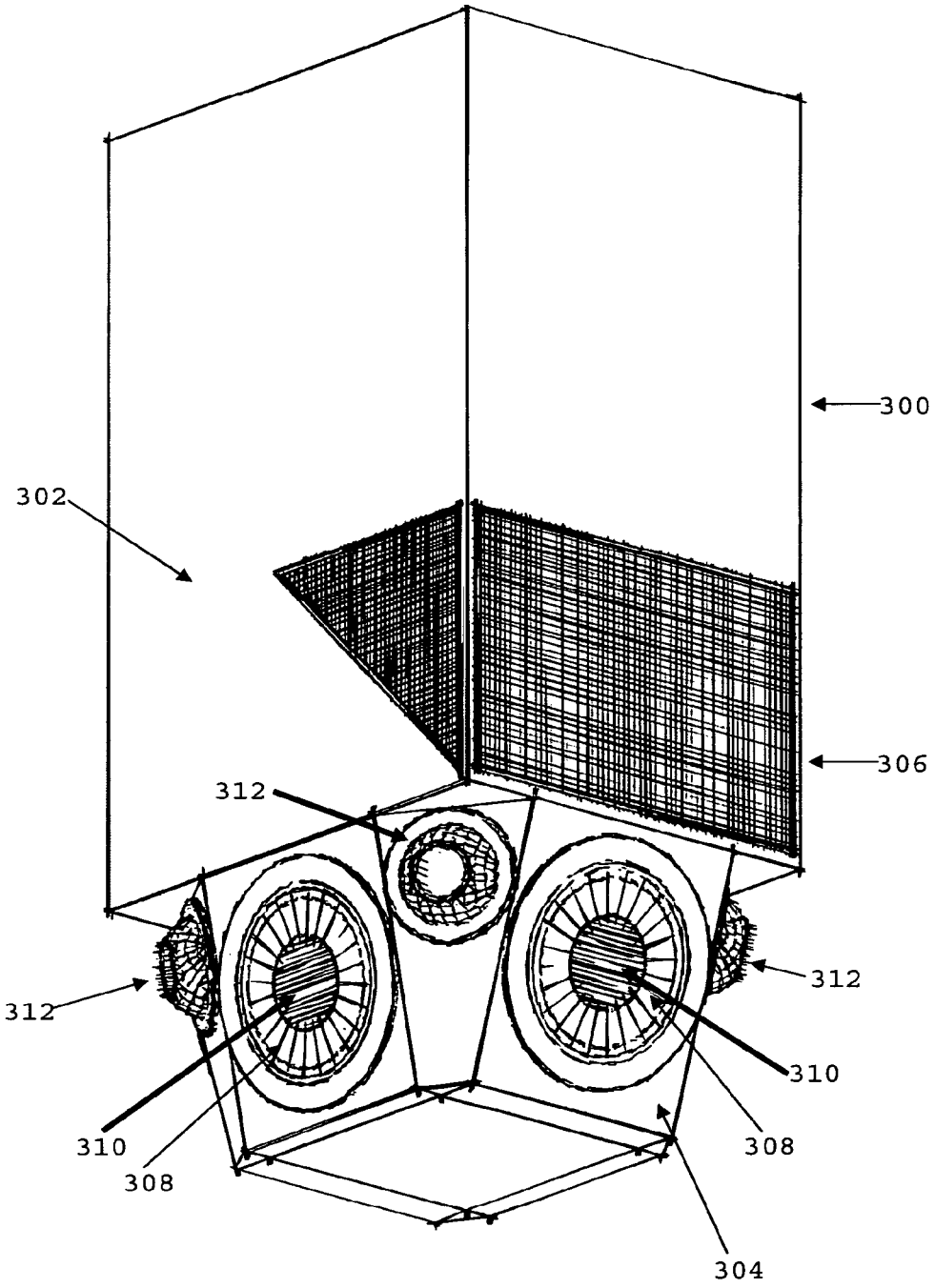
FIG. 3 is an isometric view of a system for delivering air in accordance with an embodiment of the present invention.

With reference to FIG. 3, there is illustrated an embodiment of a system for delivering air. In this embodiment, the system 300 is arranged to be installed from the roof or ceiling of a building, such as a warehouse. The system comprises a housing 302, a discharge portion 304 and a return air duct 306 arranged to receive air from within the interior of the building to be removed or reconditioned. In this example, the system 300 is connected to a heat exchange or heat-pump (not shown) directly above the system and located on the exterior of the building in order to remove the heat from the air and to pump condition air into the discharge portion 304.

The discharge portion 304 has an air discharge mechanism which in this embodiment comprises a number of first discharge arrangements 308 comprising a number of swirl diffusers, each arranged to deliver an air stream of low velocity, and a second discharge arrangement 310 comprising, in this embodiment a plurality of nozzles 310, each arranged to deliver a high velocity air stream. In some embodiments, the position of the nozzles 310 can be adjusted to change the direction of the high velocity air stream. Also, in this embodiment, the discharge portion 304 may have additional discharge apertures 312 which provide a channel for standard airflow from the plenum.

In operation, the low velocity air stream from 308 can be induced by the high velocity air stream from 310 to create a combined air stream with a largely constant throw as directed by the position of the nozzle. As the mass flow rate of the low velocity air stream can be adjusted, the air flow rate of the combined air stream created by the induction of the low velocity air stream into the high velocity air stream can therefore be varied to suit the requirements of the operating environment.

In some embodiments, the mass flow rate of the low velocity air stream may be adjusted by varying the speed of the fan which supplies air to the low velocity air stream. In other embodiments, the air stream to the low velocity discharge arrangement (310) may be varied by a damper in communication with the low velocity discharge arrangement (310) so as to adjust and control the mass flow rate of the low velocity air stream. This damper maybe electrically powered, although mechanical or manual control examples are possible.

Figure 4:
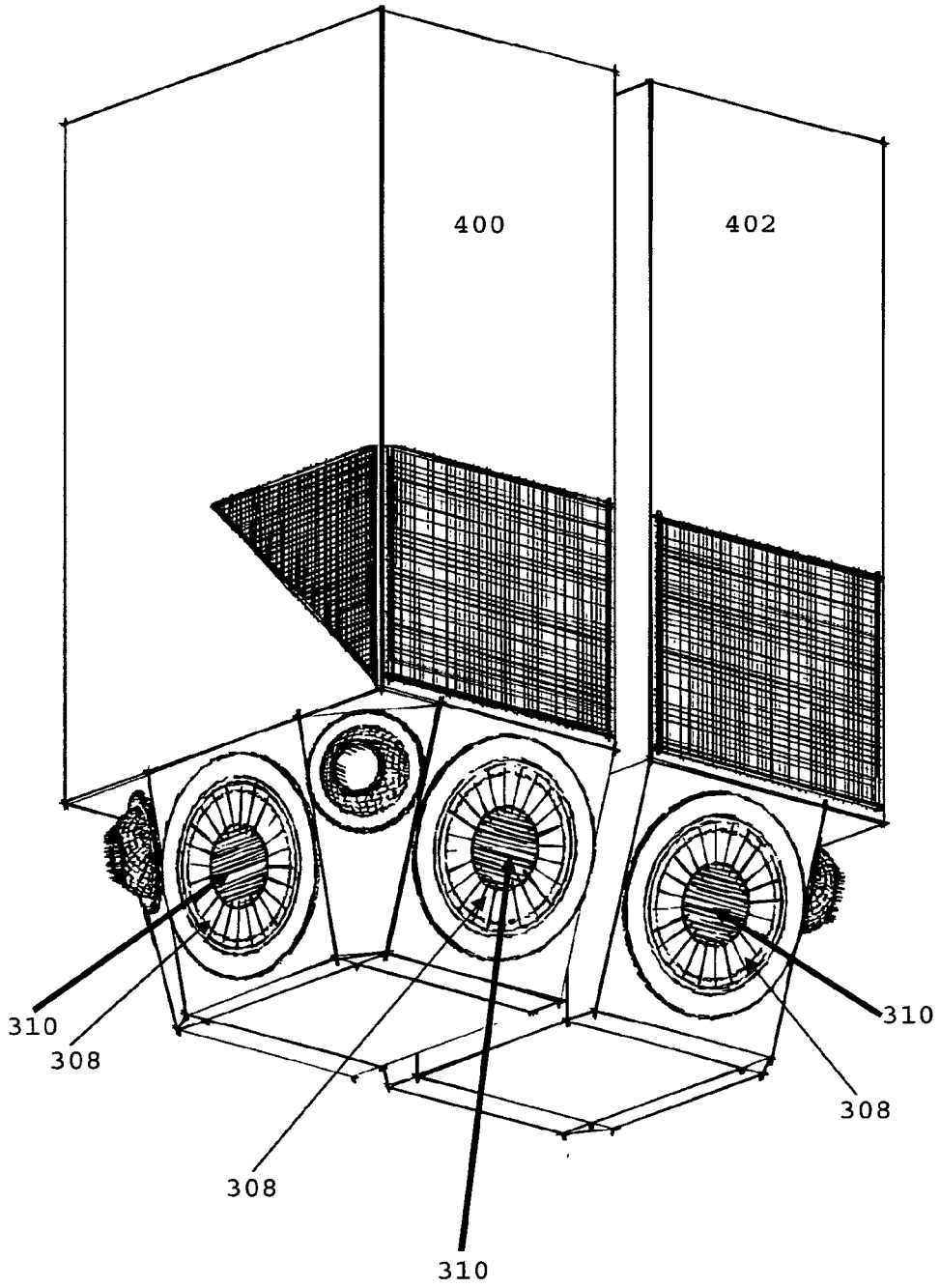
FIG. 4 is an isometric view of two systems for delivering air in accordance with an embodiment of the present invention.

Referring to FIG. 4, an alternative installation of the embodiment of the system for delivering air is shown. In this alternative embodiment, two systems 400 and 402 for delivering air are installed adjacent to each other. In this embodiment, both systems 400, 402 may be serviced by a single heat pump (not shown) or operate on different heat pumps (not shown). Other installation arrangements may be possible dependent on the requirements of the operating environment.

Figure 5:
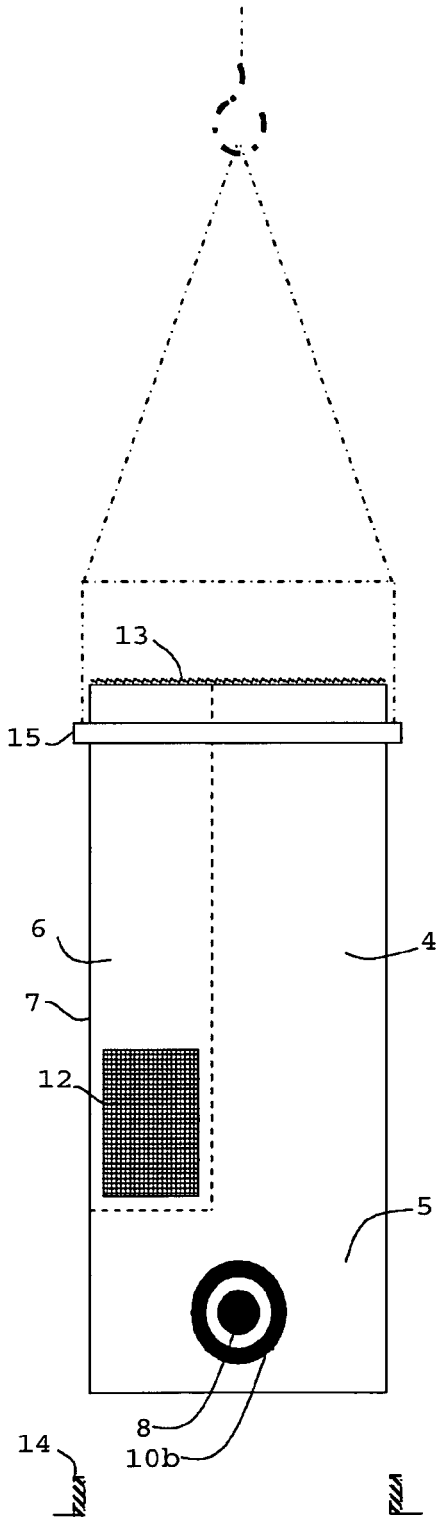
FIG. 5 is a front view of a system for delivering air in accordance with an embodiment of the present invention being installed.

With reference to FIG. 5, there is shown an installation procedure of the air delivery system through the roof of a building. As shown, the system is lowered into an aperture of a roof of a building by crane. Roof penetration upstands (14), are located or installed around the aperture of the roof prior to the lowering of the system into the aperture. In some examples, a roof gasket (not shown) may rest on roof penetration upstands (14) to form an air and water tight seal between the air delivery system, which is suspended by surrounding flange shoulder (15) to rest on roof penetration upstands (14) via the roof gasket, and the roof. Furthermore, a heatpump gasket (13) may be used to form an air and water tight seal between the air delivery system and the heatpump (not shown), which rests upon the heatpump gasket.

Once the roof gasket is placed upon the roof penetration upstand, the crane lowers the air delivery system into the aperture until the flange shoulders (15) of the system rest on the upstands (14). Based on the weight of the system, the pressing of the shoulders onto the upstands will, in some embodiments, be sufficient to provide an air and water tight seal between the aperture and the system. In some alternative embodiments, the shoulders include a resilient material which acts as a gasket to form a tight seal between the aperture and the system.

Once the system is lowered into the aperture, the heat pump, which has supply air and return air openings integrated into a flat bottom, is lowered with the supply air and return air openings aligned with the supply air 4 and return air 5 openings of the already installed system until the bottom of the heat pump compresses, by virtue of the heat pump weight, heatpump gasket 13 to form an air and water tight seal between the already installed air delivery system and the heat pump.

In alternative examples of installations, the system may be installed in a wall, ceiling, roof penetration or other portions of a structure or building.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The claims defining the invention are as follows:

1. A system for delivering air to a space, the system comprising:

a controller configured to adjust the speed of a supply air fan system to increase or decrease a volume flow rate of supply air of the supply air fan system to maintain a largely constant supply air pressure in a supply air plenum;

an outlet arranged to receive supply air from the supply air plenum and discharge a first air stream from the supply plenum, the outlet comprising a swirl diffuser;

a damper configured to vary the mass flow rate of the first air stream; and a nozzle arranged to discharge a second air stream from the supply air plenum, the nozzle being located with respect to the outlet such that the outlet surrounds the nozzle;

wherein the second air stream is arranged to induce the first air stream to deliver a combined air stream with a mass flow rate that can be varied.

2. The system for delivering air in accordance with claim 1, wherein the second air stream is a jet discharged at a higher velocity relative to the discharge of the first air stream.

3. The system for delivering air in accordance with claim 1, wherein the second air stream is a jet discharged at a higher momentum relative to the discharge of the first air stream.

4. The system for delivering air in accordance with claim 1, wherein the second air stream is arranged to control the throw of the combined air stream.

5. The system for delivering air in accordance with claim 1, wherein the second air stream is arranged to control both the direction and the throw of the combined air stream.

6. The system for delivering air in accordance with claim 1, wherein the throw of the second air stream is higher than the throw of the first air stream, if each air stream is discharged in the absence of the other air stream.

7. The system for delivering air in accordance with claim 1, wherein an induction ratio of the first air stream is larger than an induction ratio of the second air stream such that the second air stream dominates and determines the throw and direction of the combined air stream.

8. The system for delivering air in accordance with claim 1, further comprising a housing that is arranged to be connected to the supply air fan system.

9. The system for delivering air in accordance with claim 8, wherein the housing is directly connected to at least one air supply air opening in the supply air fan system.

10. The system for delivering air in accordance with claim 8, wherein the housing is connected to the supply air fan system via at least one air tight gasket.

11. The system in accordance with claim 1, wherein the supply air fan system comprises at least one variable speed drive fan.

12. The system in accordance with claim 1, further comprising an actuator configured to angle the nozzle.

13. The system in accordance with claim 1, wherein the controller is configured to increase or decrease the volume flow rate of supply air from the supply air fan system, in response to the variation made by the damper, to thereby maintain a largely constant supply air pressure in the supply plenum.

14. The system in accordance with claim 1, wherein the outlet comprises a perforated plate.

15. A system for delivering air to a space, the system comprising:

a controller configured to adjust the speed of a supply air fan system to increase or decrease a volume flow rate of supply air of the supply air fan system to maintain a largely constant supply air pressure in a supply air plenum;

an outlet arranged to receive supply air from the supply air plenum and discharge a first air stream from the supply plenum;

a damper configured to vary the mass flow rate of the first air stream; and a nozzle arranged to discharge a second air stream from the supply air plenum, the nozzle being located with respect to the outlet such that the outlet surrounds the nozzle, wherein the second air stream is arranged to induce the first air stream to deliver a combined air stream with a mass flow rate that can be varied, and wherein the angle is controllable to control the direction of the combined air stream.

* * * * *